United States Patent [19]

Oropallo

[11] Patent Number: 4,764,993

[45] Date of Patent: Aug. 23, 1988

[54] TWO-POSITION LATCHABLE DRAIN VALVE

[75] Inventor: Robert A. Oropallo, San Marino, Calif.

[73] Assignee: American Brass & Aluminum Foundry Co. Inc., Los Angeles, Calif.

[21] Appl. No.: 864,493

[22] Filed: May 19, 1986

Related U.S. Application Data

[63] Continuation of Ser. No. 710,312, Mar. 11, 1985, abandoned.

[51] Int. Cl.[4] ..... A47K 1/14

[52] U.S. Cl. ..... 4/295; 4/204

[58] Field of Search ..... 4/197–203, 4/204, 286, 287, 295; 200/159 R

[56] References Cited

U.S. PATENT DOCUMENTS

| | | | |
|---|---|---|---|
| 2,627,006 | 1/1953 | Lawson et al. | 200/159 |
| 2,869,727 | 1/1959 | Howe | 4/287 |
| 2,938,985 | 5/1960 | Brantingson | 200/159 |
| 3,739,127 | 6/1973 | Long et al. | 200/159 |
| 4,144,599 | 3/1979 | Cuschera | 4/295 X |
| 4,339,832 | 7/1982 | Cuschera | 4/295 X |

FOREIGN PATENT DOCUMENTS

| | | | |
|---|---|---|---|
| 2263662 | 7/1974 | Fed. Rep. of Germany | 4/295 |

*Primary Examiner*—Charles E. Phillips

*Attorney, Agent, or Firm*—William W. Haefliger

[57] ABSTRACT

A drain valve comprises:

(a) a drain body defining a flow port, (b) a drain cover unit movable between a down-position in which the cover closes the port, and an up-position to open the port to drain flow, the cover having a downward projection movable up and down in the port, the projection containing an upwardly extending recess, which opens downwardly, (c) a latching post carried by the drain body and extending upwardly in the recess, so as not to be movable up and down with the cover, (d) a spring anchored to the cover unit to extend downwardly into cooperative relation with the post characterized in that the post and spring yieldably hold the cover unit in centered relation to the body, and the spring also yieldably resists movement of the cover unit to down position, (e) and structure for releasably latching the projection to the post in response to movement of the cover unit to down position, and to unlatch the cover unit in response to tilting of the cover unit in down position.

3 Claims, 2 Drawing Sheets

TWO-POSITION LATCHABLE DRAIN VALVE

This is a continuation of application Ser. No. 710,312, filed Mar. 11, 1985, now abandoned.

BACKGROUND OF THE INVENTION

This invention relates generally to drains, and more particularly to valve controlled drains in which drain covers move between up or open position, and down or closed position, such drains being found in showers, bath tubs, for example.

There is need for simple, easily fabricated and assembled, reliable, and inexpensive valve controlled drains of this type. Prior drains were unreliable or to complex, or too expensive in their construction, assembly, and operation. Examples are found in U.S. Pat. Nos. 4,103,372 and 3,771,177.

SUMMARY OF THE INVENTION

It is a major object of the invention to provide an improved valve controlled drain unit meeting the above need. In accordance with the invention, the improved device comprises:

(a) a drain body defining a flow port, (b) a drain cover unit movable between a down-position in which the cover closes said port, and an up-position to open said port to drain flow, said cover having a downward projection movable up and down in said port, said projection containing an upwardly extending recess, which opens downwardly, (c) a latching post carried by said drain body and extending upwardly in said recess so as not to be movable up and down with said cover, (d) a spring anchored to said cover unit to extend downwardly into cooperative relation with the post characterized in that the post and spring yieldably hold the cover unit in centered relation to said body, and the spring also yieldably resists said movement of the cover unit to down position, (e) and means for releasably latching said projection to the post in response to said movement of the cover unit to down position, and to unlatch the cover unit in response to tilting of the cover unit in said down position.

As will appear, the post is typically yieldably retained eccentrically in said recess by said spring, and proximate one side of the recess,the opposite side of the recess spaced from the post to be tiltable toward the post; and said one side of of the recess and the post have a lengthwise extending tongue and groove interfit, which extends generally vertically, the spring extending lengthwise of the post and laterally yieldably biasing the projection into a position to slidably maintain said interfit. In this regard, the spring is preferably a coil spring, and has its lower end retained by and in alignment with the post, and its upper end retained by and in alignment with the cover unit, whereby the spring tends to urge the groove, which is in said projection, toward the tongue, which is on the post.

More specifically, the cover unit typically has a centering boss extending into the spring so that the spring coils about the boss; and the cover unit preferably also has multiple shoulders spaced about the boss, to frictionally interfit and retain the spring in a position to yieldably retain the spring extending longitudinally. This enables ready assembly of the components, in a straightforward manner, eliminating risk of malfunction.

These and other objects and advantages of the invention, as well as the details of an illustrative embodiment, will be more fully understood from the following specification and drawings, in which:

DRAWING DESCRIPTION

DETAILED DESCRIPTION

Figure 1:
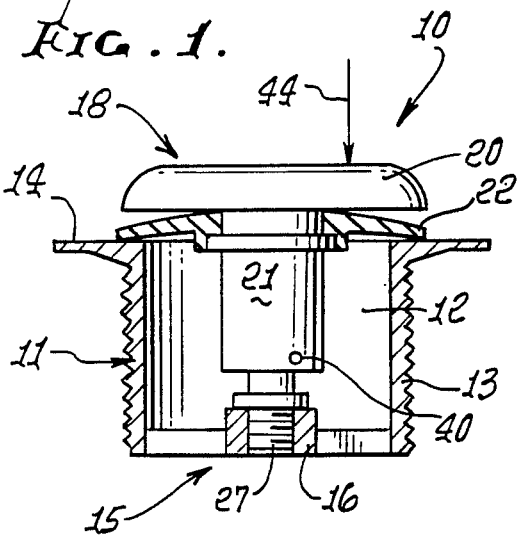
FIG. 1 is a side elevation, in section, showing a tilting drain valve.

In the drawings, the drain valve 10 includes a drain body 11 defining a flow port 12. The body may include a lower tubular portion 13, an upper outer flange 14, a spider 15 integral with the lower extent of portion 13, and a central annular hub 16.

Figure 2:
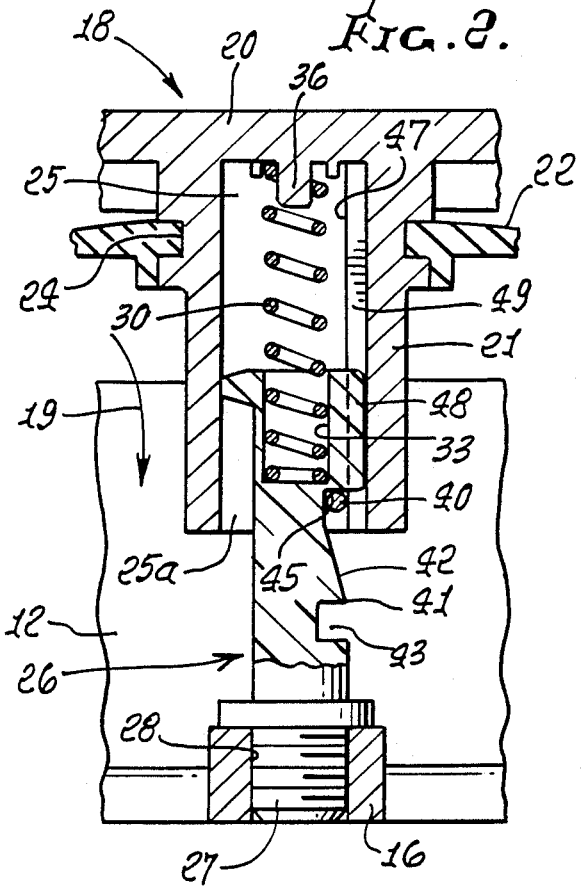
FIG. 2 is an enlarged fragmentary elevation showing interval construction of the valve in open configuration.
Figure 4:
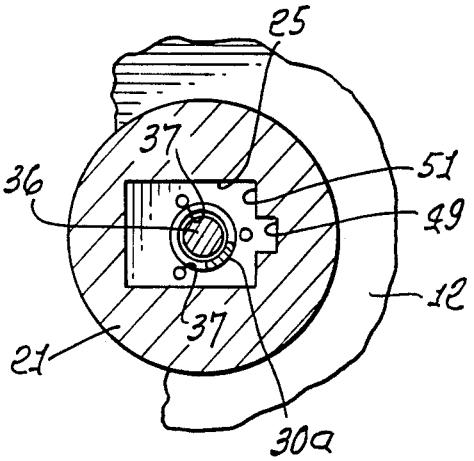
FIG. 4 is a further enlarged elevation showing spring anchoring.
Figure 3:
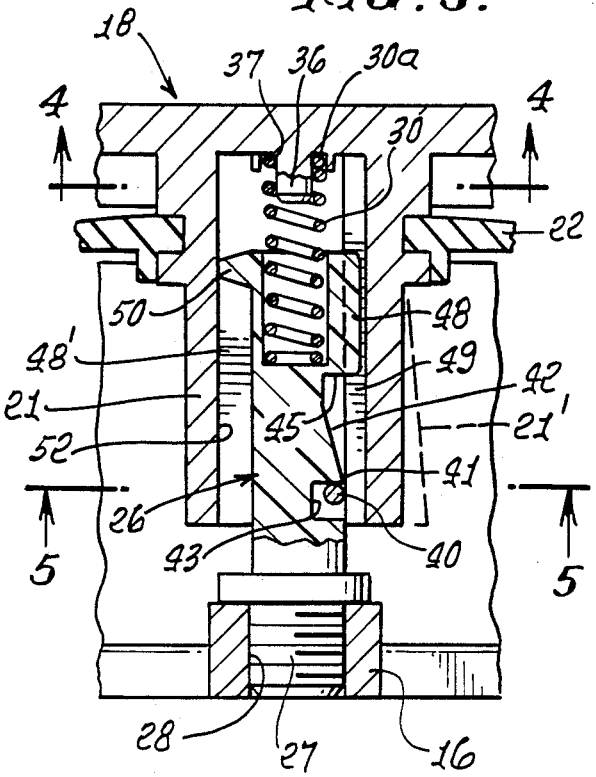
FIG. 3 is like FIG. 2, but showing the valve in closed configuration.

A drain cover unit 18 is movable between a down position (see FIGS. 1 and 3) in which the cover closes the upper end of port 12, and an up-position (see FIG. 2) to open the port to drain flow, as indicated by arrows 19. The cover includes a circular upper flange 20 sized to overhang the port 12, a central downward projection 21 integral with the flange to be movable up and down in port 12, and an annular seal 22 carried by the projection. The seal, which is flexible and may consist of elastomeric material such as rubber, is adapted to engage the flange 14 to seal the port 12, in down-position as shown in FIG. 1. At that time, the cover is spaced above the flange, so that it can be tilted, thereby tilting the projection (see broken lines 21' in FIG. 3) so as to unlatch the projection allowing the cover unit to be spring-urged upwardly to FIG. 2 position, as will be explained in detail. Note that seal 22 has its inner annular periphery retained in an annular groove 24 in the projection. Note further that the projection contains an upwardly extending recess or bore 25, which opens downwardly at mouth 25*a*. Cover 20 and projection 21 may consist of molded plastic material, which may be plated, as with chromium.

A latching post 26 is carried by the drain body 11 to extend upwardly in recess 25, and so as not to be movable up and down with the cover unit, relative to the body 11. For this purpose, the post may have its lower end threaded at 27 to attach to the threaded bore 28 of hub 16. The post typically extends vertically upwardly, and centrally, within the port 12, as shown.

A spring 30 is anchored to the cover unit to extend downwardly into cooperative relation with the post and characterized in that the post and spring yieldably hold the cover unit in centered, normally untilted, relation to the body 11 and port 12, the spring also resisting movement of the cover unit to down position. Thus the parts are so arranged that the spring has multiple functions, for essential simplicity and reliability and minimized number of parts. As shown, the spring is a coil spring, with its lowermost coils closely received in a recess 33 in the upper end of the post, whereby the spring lower end always extends in vertical alignment with the post.

Further, the uppermost coils of the spring are closely received by alignment structure of the cover unit so as always to remain in centered and aligned relation with projection 21, whereby both ends of the spring being so anchored, the spring yieldably urges the cover unit toward an untilted condition of the spring wherein the projection extends vertically, as does the post.

Of unusual advantage for this purpose are the provision of a centering boss 36 integral with the cover unit, and multiple small projections also integral with the cover unit providing internal shoulders 37 spaced about and from the boss 36, the upper coils of the spring slidably and tightly received over the boss, and the uppermost coil 30*a* slidably and tightly received inwardly against the shoulders 37.

Latching means is also provided to latch the projection 21 to the post in response to downward movement of the cover unit to down position, and to unlatch the cover unit in response to tilting of the cover unit in down position, as described. See for example the transverse pin 40 carried by the projection 21, to extend beneath the edge 41 of the downward and laterally angled cam or ramp 42, i.e. in notch 43; the spring 30 is compressed at that time, and to urge the pin upwardly against the underside of edge 41. When the cover unit is then momentarily tilted to position 21', as by downward pressure at 44, the pin 40 rides out from under edge 41, and rides upwardly along ramp 42, and spring 30 tends to straighten upwardly to cause projection 21 to assume vertical orientation, so that pin 21 rides up under ledge or stop shoulder 45 and is trapped in FIG. 2 position—i.e. up-position of the cover unit.

Figure 5:
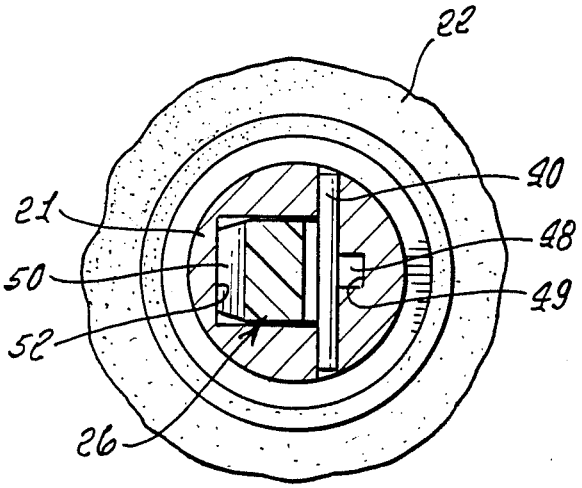
FIG. 5 is a bottom view of the valve cover unit.
Figure 6:
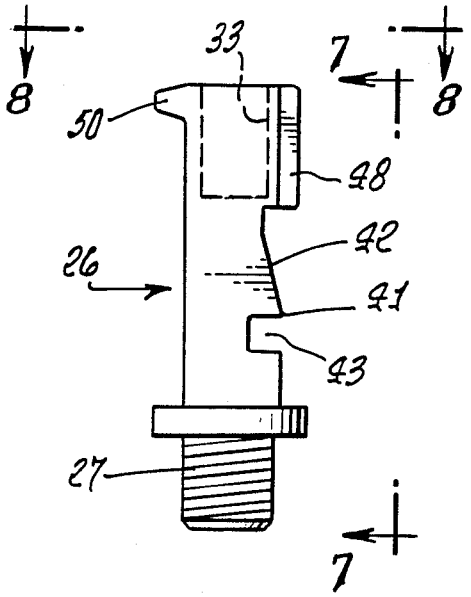
FIG. 6 is a further enlarged side elevation showing construction of a post.
Figure 7:
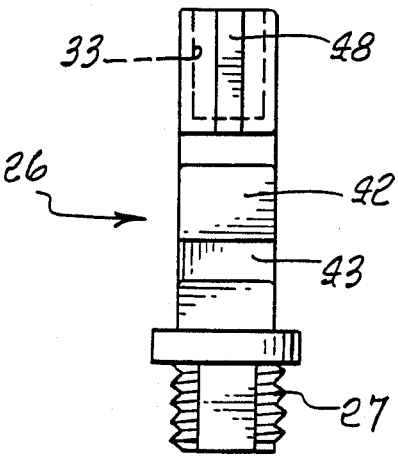
FIG. 7 is a side elevation on lines 7—7 of FIG. 6.
Figure 8:
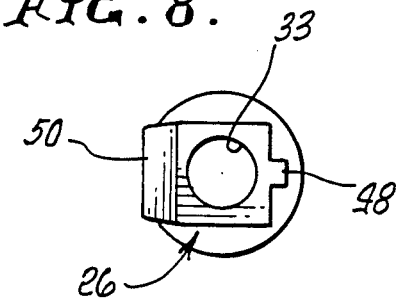
FIG. 8 is a top plan view on lines 8—8 of FIG. 6.

The above functioning is further aided by the following structure; note that the post and one side 47 of the recess 25 have vertically elongated, tongue and groove sliding interfit. See tongue 48 and groove 49, in FIG. 5. As the projection 21 is tilted, the groove 49 in the wall 47 is dispaced relatively away from the tongue, but their interfit continues, to guide the projection lateral movement back toward upright position, and as the projection also moves upwardly relative to the tongue. Thus both lateral and vertical guiding action are assured by the tongue and groove, so that the described latching and unlatching action, and up and down movement, are assured.

As the cover unit is pushed downwardly to closed position, the pin 40 rides on cam surface 42 to tilt the projection laterally to position 21', and ultimately the pin snaps under the lip or edge 41 as pin 40 registers with notch 43, the spring 30, tending to straighten, causing the pin to enter the notch, accomplishing latching. The tongue and groove interfit also assures proper tilting direction. The side or bore surface 52 of the projection approaches the post, during tilting. Projection 50 on the upper end of the posts extends close to side 52 of the projection, to provide a fulcrum for pivoting, to maintain space 48, and to cooperate with spring 30 to keep the post eccentrically positioned in recess 25, close to wall 51 of the projection so that pin 40 will enter the notch 43. Fulcrum 50 is also at the opposite side of the post from tongue 48, so that the upper part of the tongue always remains in groove 49.

I claim:

1. In a drain valve, the combination comprising (a) a drain body defining a flow port, (b) a drain cover unit movable between a down-position in which the cover closes said port, and an up-position to open said port to drain flow, said cover having an integral downward projection movable up and down in said port, said projection containing an upwardly extending recess, which opens downwardly, the projection having a bore about the recess, (c) a latching post carried by said drain body and extending downwardly in said recess so as not to be movable up and down with said cover, (d) a single upright coil spring means anchored to said cover unit to extend downwardly into cooperative relation with the post characterized in that the post and spring yieldably hold the cover unit in centered relation to said body, and the spring means also yieldably resists said movement of the cover unit to down position, (e) and means for releasably latching said projection to the post in response to said movement of the cover unit to down position.

(f) one side of the recess and the post having a lengthwise extending tongue and groove interfit, which extends generally vertically, the spring means extending lengthwise of the post to exert force via the spring means upper end above the projection for laterally yieldably biasing the projection into a position to slidably maintain said interfit, the cover unit having a centering boss engaging and projecting downwardly into multiple coils at the upper end of the coil spring means so that the spring means upper end connects to and aligns with the boss and cover unit, the cover unit having shoulders that frictionally interfit and retain the spring means in an anchored position to yieldably retain the spring means extending longitudinally, the spring means having its lower end retained by and in alignment with the post, and its uppermost end fixedly retained by and in fixed alignment with the cover unit, whereby the spring means tends to urge the groove, which is in said projection, toward the tongue, which is on the post, the post being free of any sidewardly extending spring below the lower end level of said coil spring means, (g) the post being yieldably retained eccentrically in said recess by said spring means, and proximate one side of the recess, the opposite side of the recess spaced from the post to be tiltable toward the post, (h) said latching means including a pin carried by the projection and a downward and lateral cam shoulder on the post and defining a lip under which the pin snaps as the cover unit is moved to down position, (i) the post consisting of molded plastic material, and including a fulcrum on the post upper end, laterally spaced from the spring, to engage the bore of the projection at the side thereof opposite and above the level of the pin, whereby tilting of the cover unit is controlled.

(j) the fulcrum being at the side of the post opposite the tongue.

2. The combination of claim 1 wherein, the cover unit consisting of molded plastic material and shoulders comprising downwardly extending projections engaging the periphery of the spring means uppermost end.

3. The combination of claim 1 wherein, said cover unit including a top flange, and an annular seal carried below said flange to annularly seal against said drain body in said down position.

* * * * *